United States Patent [19]

Pope

[11] Patent Number: 4,823,108

[45] Date of Patent: Apr. 18, 1989

[54] DISPLAY SYSTEM AND MEMORY ARCHITECTURE AND METHOD FOR DISPLAYING IMAGES IN WINDOWS ON A VIDEO DISPLAY

[75] Inventor: Gary W. Pope, Los Angeles, Calif.

[73] Assignee: Quarterdeck Office Systems, Santa Monica, Calif.

[21] Appl. No.: 169,304

[22] Filed: Mar. 17, 1988

Related U.S. Application Data

[63] Continuation of Ser. No. 606,336, May 2, 1984, abandoned.

[51] Int. Cl.[4] ..... G09G 1/16

[52] U.S. Cl. ..... 340/721; 340/724; 340/799; 364/521

[58] Field of Search ..... 340/721, 724, 798, 799, 340/716, 750, 723; 364/521

[56] References Cited

U.S. PATENT DOCUMENTS

| | | | |
|---|---|---|---|
| 4,119,953 | 10/1978 | Yeschick | 340/750 |
| 4,125,873 | 11/1978 | Chesarek | 340/794 |
| 4,232,376 | 11/1980 | Dion et al. | 340/750 |
| 4,414,628 | 11/1983 | Ahuja et al. | 364/900 |
| 4,482,979 | 11/1984 | May | 340/750 |
| 4,484,302 | 11/1984 | Cason et al. | 340/721 |
| 4,533,910 | 8/1985 | Sakonick et al. | 340/724 |
| 4,550,315 | 10/1985 | Bass et al. | 340/721 |
| 4,550,386 | 10/1985 | Hirosawa et al. | 340/721 |
| 4,555,775 | 11/1985 | Pike | 340/734 |
| 4,757,441 | 7/1988 | Buckland et al. | 340/721 |
| 4,761,642 | 8/1988 | Huntzinger | 340/721 |

*Primary Examiner*—Gerald L. Brigance

*Attorney, Agent, or Firm*—Hecker & Harriman

[57] ABSTRACT

A method for displaying information within windows which are capable of overlapping on a video display of a computer controlled video display system, wherein said windows are defined by an operating environment on the video display independently of the writing of said video display data comprising the steps of:

providing a memory means within said computer including at least one pseudo-screen buffer memory means for storage of display data;

writing display data to said at least one pseudo-screen buffer memory means without calling said operating environment;

storing current display data in said pseudo-screen buffer memory means;

determining the visible display area of said windows on said video display for video display data associated with said windows; and displaying said video display data associated with said windows from said pseudo screen buffer memory means on said visible display area of said windows.

13 Claims, 6 Drawing Sheets

M
M1
T0

T1

T2 = Tint1

T3

T4 = Tint2

FIG.5c
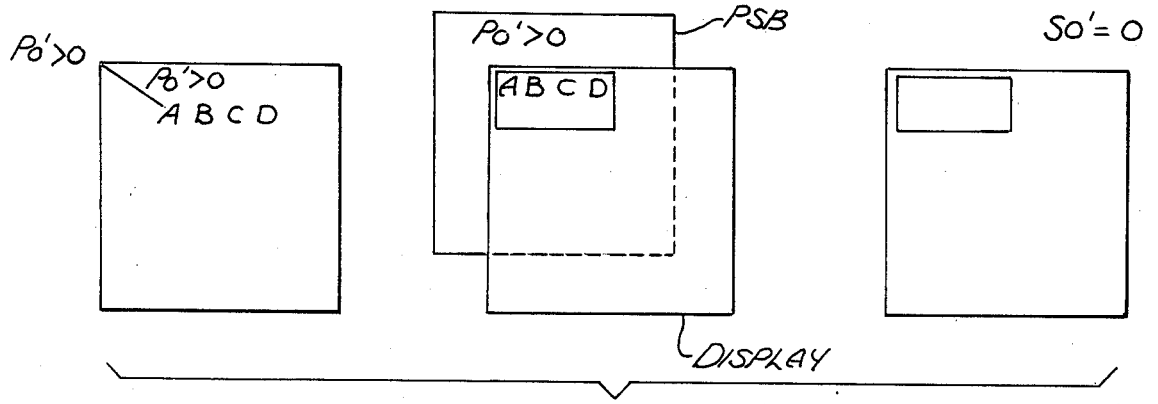
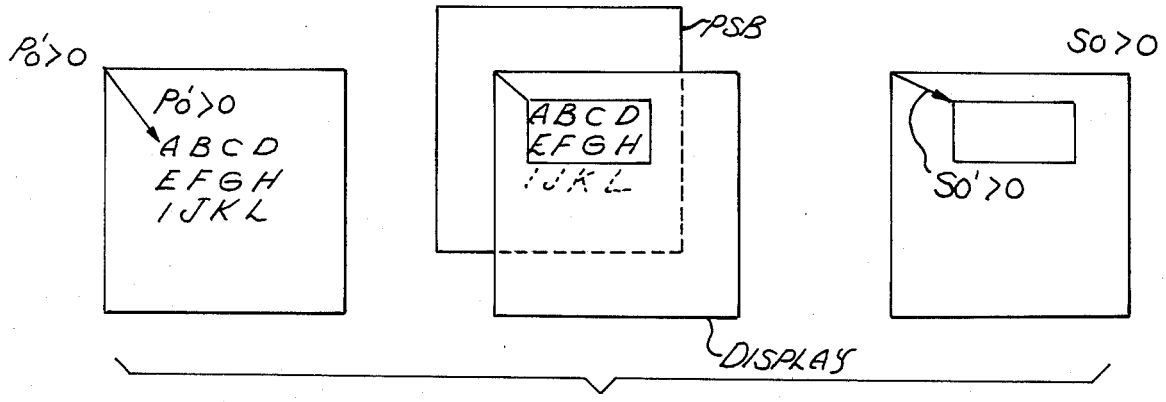
FIG.5d
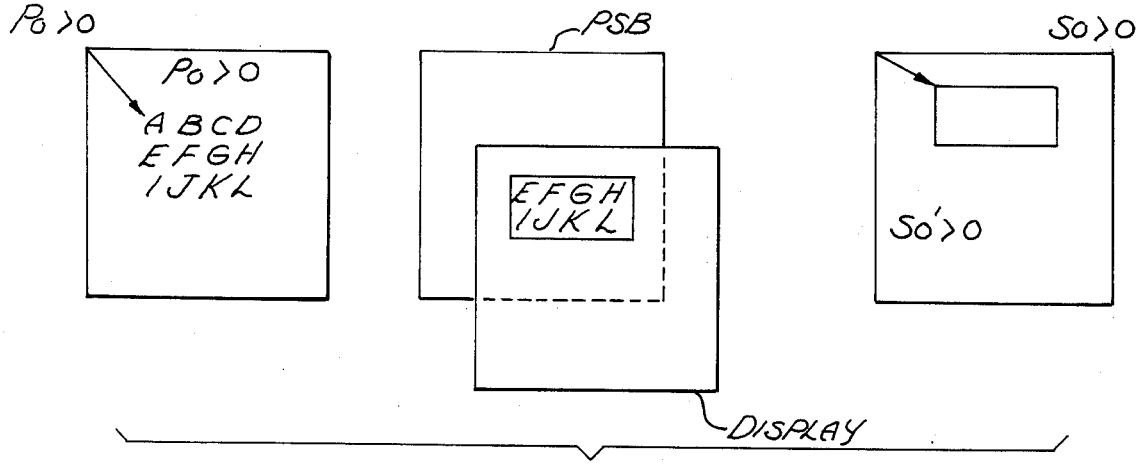
FIG.5e

DISPLAY SYSTEM AND MEMORY ARCHITECTURE AND METHOD FOR DISPLAYING IMAGES IN WINDOWS ON A VIDEO DISPLAY

This is a continuation of application Ser. No. 606,336, filed 5/2/84, now abandoned.

BACKGROUND OF THE INVENTION

In modern computing there has recently been considerable attention paid to improving the user interface in an effort to create an operating environment that is easy and efficient to use. The term operating environment in this context refers to everything in a computer that a user can directly access and utilize in a unified and coordinated manner. In improving the user interface, there have been various efforts to create an operating environment that is integrated, that is, one which allows activities for various applications to be interweaved without losing an accumulated information and without sacrificing capability.

One aspect of integration focuses on the ability to access multiple applications or processes that reside in the computers main memory utilizing a single key stroke, command, or cursor movement within "windows". A window is a viewing area on a video display which may be a full screen region or smaller, and represents a bordered region, typically of rectangular shape, into which display data from application programs and the like are written. The use of a multiple window graphic interface is one approach in modern computing to creating a "desktop" metaphor interface.

In typical prior art video display systems and memory architectures, a single application program is implemented at one time. Thus, the application program can write directly to the video display buffer without interfering with concurrent display data output, because only display data of that single application program is displayed.

In recent attempts to create windowing environments, for computers using prior art memory structures, data, such as alphanumeric characters or graphic images to be displayed within single or multiple windows are temporarily stored in a video display buffer and then written directly to the video display. A particular application program running in the windowing environment must call the environment to determine the size and location and video display ownership priority of the current window.

In the prior art, display data from an application program is written only to that portion of the video display defined by the window which the program has identified. If a window on the video display is moved, or its size or ownership priority changed, the application program must be designed to implement a change in the display data that will be written to that window. Thus, to use existing application programs in prior art windowing environments, the program typically must be rewritten to accommodate for the architecture of that particular windowing environment. Thus, effective operation of the environment is "program dependant".

In addition, the video display buffer in prior art systems must be continuously updated since there is no high speed reference means for determining when there has been a change in display output data.

When an environment is introduced to the display system, such as a windowing environment, windows, (e.g. bounded or boardered regions), and display data, (e.g. application programs), typically appear on the video display concurrently. Also, display data from a particular application program typically must be written into a single window defined by the environment on the display, rather than to the entire display area. In the prior art, this accomplished by providing an operating environment that requires application programs to call the operating environment to determine current window parameters, and to insure that application program display data is written into selected windows. Thus, the prior art systems suffer the drawback of requiring that the application programs be structured or rewritten to call the operating environment instead of writing directly to the video display.

SUMMARY OF THE INVENTION

Figure 1:
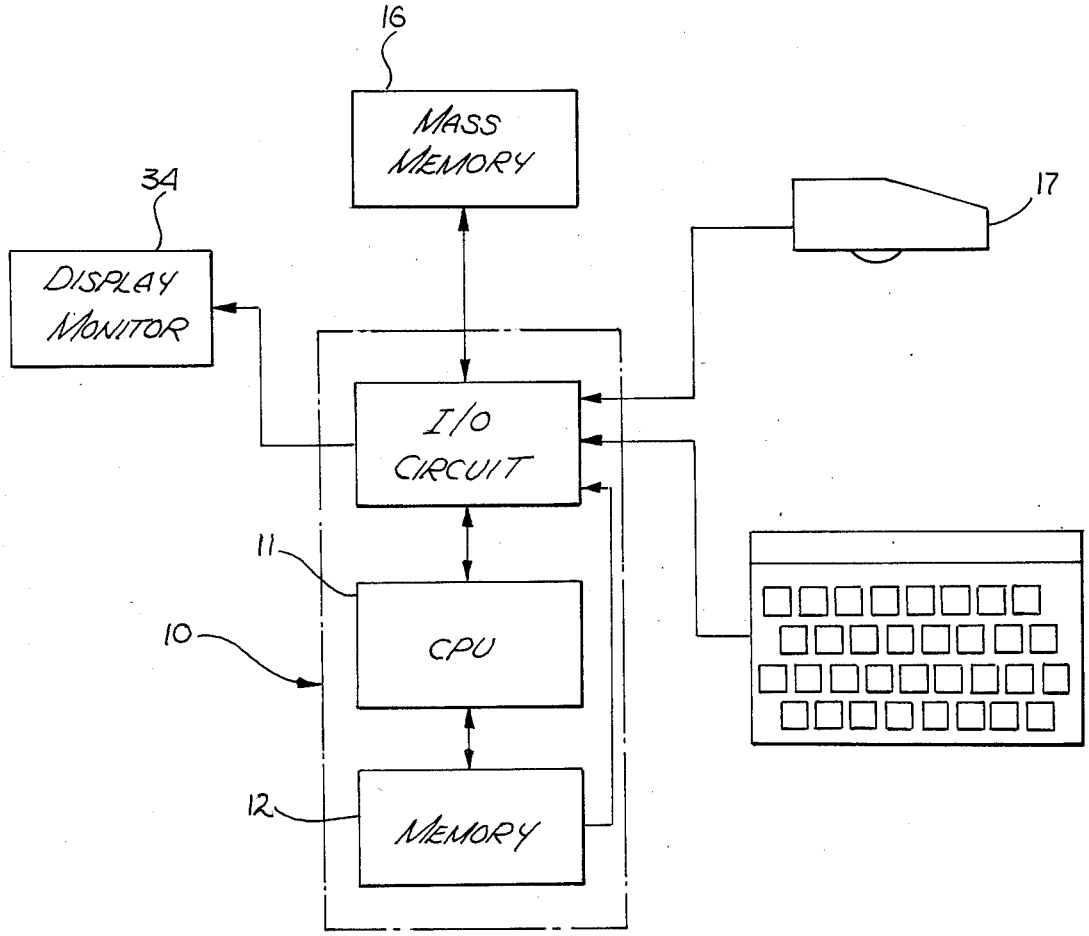
FIG. 1 illustrates a computer that incorporates the present invention.

The present invention provides methods and apparatus which are used in conjunction with a digital computer for displaying the output of computer programs within windows defined by an operating environment on a video display monitor. The present invention enables computer program output display data to be written within windows on the video display without the necessity of having to call an operating environment to determine the physical characteristics of a particular window, size, location, and display area ownership.

The windows that appear on the video display are defined independently by the operating environment. Application programs intended for use in connection with the present invention need not necessarily be written with windows in mind. That is, substantial modifications to the application program need not be made for use in connection with the windows defined by the operating environment.

Typically, in the prior art, program display data output is written directly to a screen buffer and then displayed. However, where windows appear concurrently on the display, display data simultaneously written to that display would not appear in windows. Rather, it would appear written on the entire screen area. Utilizing the present invention, such display data will appear in selected windows.

In accordance with the present invention, display data is written to a pseudo-screen buffer for temporary storage of display data. A timer interrupt interrupts the writing of display data at selected intervals. During those selected intervals, the contents of the pseudo-screen buffer is compared with the contents of a previous image buffer. For those memory locations where associated contents are determined to differ, the differing contents are written into the previous image buffer. Thus, changes in display data are identified and updated periodically.

Timer interrupt intervals are accelerated during events that are associated with increased frequency of changes in display data. Further, comparison between a pseudo-screen buffer and previous image buffer is confined to the memory regions within the vicinity of changes that during such events. Thus, system overhead and video display image response time are optimized for maintaining high system performance. Means are provided to determine whether a given character currently stored in the pseudo-screen buffer will appear on the visible portion of its associated window on the video display monitor. The relation between the first display data memory location and the pseudo-screen buffer, and the first character of display data associated with a particular window in the pseudo-screen buffer, is determined.

Further, the relation between the first display monitor coordinate location and the first character location of an associated window on the video display is determined. From these operations, a window offset' is determined. Also, a pseudo-screen buffer offset is determined for each arbitrary or selected character on the pseudo-screen buffer which have changed during a timer interrupt, and for all other characters update mode which are intended for display on the video display monitor. From the window offset and the pseudo-screen buffer offset, a "new" screen offset is determined representing the coordinate locations on the video display for associated pseudo-screen buffer display data locations in connection with associated windows defined independently by the windowing environment.

Having determined where display data should appear within a window on the video display monitor, in accordance with the present invention, it is next determined whether or not an associated window region is visible on the video display. It is necessary to determine this because windows frequently overlap, in which case only display data that is to appear in the 'uppermost' or 'priority' window should be written to the video display in that overlapping region. Further, a window may extend off the video display screen boundary, in which case the display data would not appear on the video display at all.

In the present invention, the visibility of a particular window region on the video display is denoted as window 'ownership'. A screen map is provided which contains a parallel representation of the windows appearing on the video display. Each pseudo-screen buffer associated with a particular application program is assigned a label, such as integers 1 through n, to identify each such pseudo-screen buffer. The integer value identifier of an associated pseudo-screen buffer is written into each memory location of a memory map where that pseudo-screen buffer display data would be visible within a window.

In the foregoing manner, display data from the pseudo-screen buffer is updated, its associated location in a window on the video display is defined, and whether or not that display data is visible on the video display is determined. Further, means are provided for writing the visible display data into its associated window on the video display.

Thus, by utilizing a crystal controlled timer interrupt clocking mechanism, in conjunction with a pseudo-screen buffer, previous image buffer, and screen map memory regions, selected display data is written into independently defined windows on a video display for manipulation and processing in an interactive windowing user interface. Further, this task is accomplished without sacrificing overall system performance because display data writing response time and system overhead, is optimized for desired system operation. Thus, off the shelf application programs can be written into selected windows of the windowing environment at high speed.

NOMENCLATURE AND DEFINITIONS

The detailed descriptions which follow are presented in part in terms of algorithms and symbolic representations of operations on data bits within a computer memory representing alphanumeric characters or other information. These descriptions and representations are the means used by those skilled in the data processing arts to most effectively convey the substance of their work to others skilled in the art.

An algorithm is here, and generally, conceived to be a self-consistent sequence of steps leading to a desired result. These steps are those requiring physical manipulations of physical quantities. Usually, though not necessarily, these quantities take the form of electrical or magnetic signals capable of being stored, transferred, combined, compared, and otherwise manipulated. It proves convenient at times, principally for reasons of common usage, to refer to these signals as bits, values, symbols, characters, display data, terms, numbers, or the like. It should be borne in mind, however, that all of these and similar terms are to be associated with the appropriate physical quantities and are merely used here as convenient labels applied to these quantities.

Further, the manipulations performed are often referred to in terms, such as comparing or adding, commonly associated with mental operations performed by a human operator. No such capability of a human operator is necessary, or desirable in most cases, in any of the operations described herein which form part of the present invention; the operations are machine operations. Useful machines for performing the operations of the present invention include general purpose digital computers or other similar devices. In all cases the distinction between the method operations in operating a computer and the method of computation itself should be recognized. The present invention relates to method steps and apparatus for operating a computer in processing electrical or other (e.g., mechanical, chemical) physical signals to generate other desired physical signals.

The present invention also relates to an appartus for performing these operations. This apparatus may be specifically constructed for the required purposes or it may comprise a general purpose computer as selectively activated or reconfigured by a computer program stored in the computer. The algorithms presented herein are not inherently related to any particular computer or other apparatus. In particular, various general purpose machines may be used with programs written in accordance with the teachings herein, or it may prove more convenient to construct more specialized apparatus to perform the required method steps. The required structure for a variety of these machines will appear from the description below.

In the following description, several terms are used frequently, have specialized meanings in the present context, and are thus defined. The terms "environment", "windowing environment" and "running in windows" are used interchangeably to denote a computer user interface in which information is manipulated and displayed within bounded regions on a raster scanned video display.

The term "pseudo-screen buffer" is used herein to desribe a portion of memory of the present invention to which video display data is written directly from an application program during its execution, and stored temporarily prior to being written to the video display. Thus, by simple analogy, the pseudo-screen buffer is similar to a scratch writing pad where information is written temporarily until it is rewritten in its final desired form or discarded. The term "pseudo" screen buffer is chosen as appropriate because display data is written to this region of memory from the application as if it were writing directly to a screen buffer as in the prior art. It should be noted that a separate pseudo-screen buffer is utilized for each different application program being run in the windowing environment.

The terms "application", "application program", and "program" are used interchangeably herein to refer to any computer program run in conjunction with the present inventive system.

The term "current" is sometimes used herein as an antecedent to "window", "application", etc., and is used to denote system components which are currently being utilized or performing operations with respect to a particular application program running in the environment.

Each application program or system component or operator is often referred to as having an "associated pseudo-screen buffer", and an "associated window", etc. The term "associated" is used to refer to associated system components during a particular time or operation. For example, display data from application programs 1 through n are written to associated pseudo-screen buffers, associated window, and associated screen map windows, 1 through n, respectively.

DETAILED DESCRIPTION

An improved computer memory architecture and method is disclosed for use by a digital computer in combination with a video display or other suitable output means to provide an "application program display output-independent" windowing environment; that is, one in which the size, location, and priority are determined and windows placed on the display, independently. In the following description, certain details are set forth to provide a complete understanding of the present invention. It will be apparent to one skilled in the art, however, that these specific details are not required in order to practice the present invention. Also, well known electrical structures and circuits are depicted in block diagram form so as not to obscure the present invention unnecessarily.

In prior art video display systems used in conjunction with windowing environments, a particular application program currently running calls the operating environment to determine the location and size of an associated window on the video display. The current frame of display data of the application program is then written directly to the video display by the operating environment. The CPU may then read, write or modify the data within the computer's memory for subsequent display on the video monitor.

However, application programs that are not written or designed to run in a particular windowing environment typically cannot be written into a window defined by that environment unless the application program is modified significantly, since the existence of the windowing environment is essentially unknown to the program. Absent significant application program modification, or if the program is not originally written specifically for the windowing environment, it will write to the entire video display area, rather than into a current window.

It has been found that system performance is significantly reduced when, as in the prior art, the application program must call the operating environment in order for display data to be written into windows. This loss in performance is due primarily to increased processor overhead which substantially reduces the speed at which the display data will be written to the screen. The present inventive system provides a solution to this problem.

FIG. 1 shows a typical computer-based system for displaying data such as alphanumeric characters and the like according to the present invention.

Referring now to FIG. 1, a computer 10 is shown which comprises three major components, a central processing unit 11, memory, and I/O circuit 14 which is used to communicate information in appropriately structured form, to other parts of the computer system. Regions of memory, described in detail below, include main memory 12, and mass memory storage 16. A portion of main memory will typically include one or more applications programs, such as, for example, spread sheets, data base managers, graphics programs and the like. As in most computer systems, these primary memory regions are also coupled to input devices such as a cursor control 17 or keyboard 19.

A portion of mass memory storage 16 will typically store any programs and data for managing the system windowing environment to which the present invention relates. It should be appreciated, however, that both application programs and windowing environment related programs may be stored equally or alternatively in either main memory 12 or mass storage memory 16, or in other forms of memory widely known and used in the art.

FIG. 1 shows one embodiment of the present invention in functional block diagram form which overcomes the disadvantages found in prior art video display systems used in conjunction with prior art computers, represent a typical although not required, sequence or order of operations and functions performed by the present inventive apparatus. It should be appreciated that some or all of the functions and operations shown and described in connection with FIG. 2 may occur in an alternative sequence or simultaneously using techniques widely known in the art.

Figure 2:
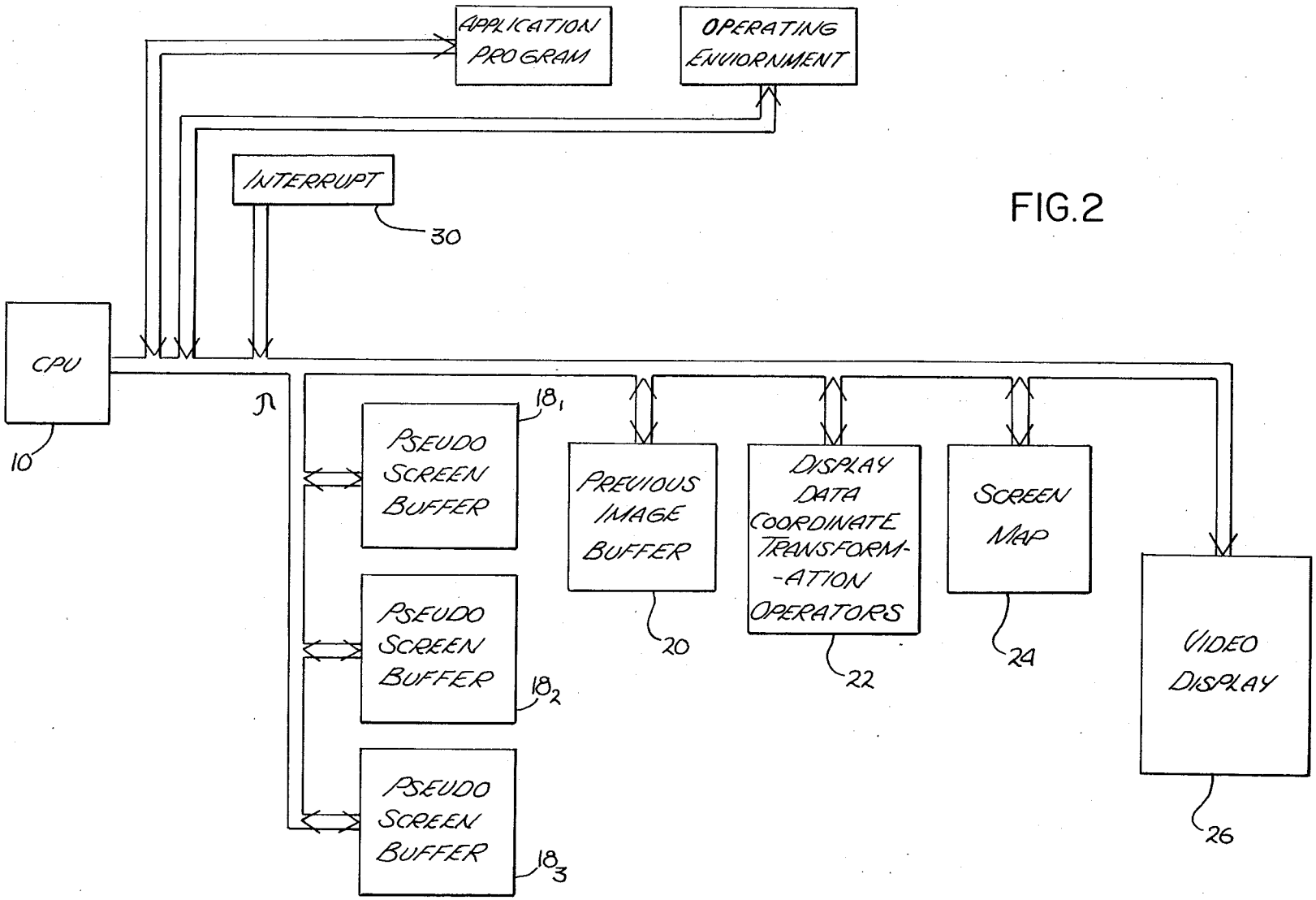
FIG. 2 is a functional block diagram of one embodiment of a typical computer utilized in connection with the present invention.

Referring now to FIG. 2, the CPU 11 is also coupled to specialized memory regions, including pseudo-screen buffer 18, previous image buffer 20, display data coordinate transformation means 22 and screen map 24, described in detail in the discussion which follows. These memory regions and operators may comprise separate memory structures and electrical or other devices, may alternatively comprise regions of main memory 12 or mass storage 16.

Current display images or "frames", which consist of alphanumeric characters and graphic representations appearing within windows, are displayed on a video display 26 which is coupled to the screen map 24, pseudo-screen buffers 18 and previous image buffer 20.

In prior art video display systems which incorporate a windowing environment, the display images of a current application program typically are written directly to the video display 26 from a video display buffer. For example, in data processors of the type known as the IBM XT manufactured by International Business Machines, upon initial program execution, the CPU must typically be queried by the application program to determine if it has a monochrome or color video display. If the video display is determined by the application program to be monochrome, display data from the application program is written directly into the monochrome display buffer which, on the IBM PC, is at memory location B0000. If, on the other hand, the video display is determined to be a color video display, program display data is written directly into the color display buffer beginning at address location B8000.

In contrast, in the present invention, application program display data is written temporarily into a pseudo-screen buffer 18 in the same manner as if it were being written directly to the screen buffer. The pseudo-screen buffer, like the screen buffer of the prior art, stores a copy of program display data which comprises a character or bit map representation of display elements defined by coordinates on a display device such as video display 26.

When video display output for multiple application programs is to be displayed in multiple windows on the video display, the current image data for each application is stored in pseudo-screen buffers $\mathbf{18}_{(1)}$ through $\mathbf{18}_{(n)}$, where n equals on the number of application programs currently running or being displayed in windows. A timer interrupt 30 which is typically a crystal controlled timing device implemented in hardware to interrupt the CPU11, is coupled to the CPU 11, memory regions 18 through 24, and to the system I/O devices (shown only in FIG. 1) for interrupting application program processing at selected intervals described in further detail below.

Updating Display Data

Referring generally to FIGS. 1(*b*) and 3 and coding entitled Background Pad Updater, attached and incorporated herein, periodically, timer interrupt 30 interrupts the operation of application programs that are running in a currently visible window on the video display 26. During interrupt intervals, the CPU 11 reads the contents of both the current pseudo-screen buffer 18 and the previous image buffer 20, which have corresponding memory mapped addresses for storage of output display data. The contents of the pseudo-screen buffer and previous image buffer contents are then compared. If, upon comparison, their contents are determined to be different at any corresponding memory locations, the contents of the associated memory locations in the pseudo-screen buffer are written into the corresponding memory locations of the previous image buffer. Thus, the previous image buffer 20 is updated during each preselected timer interrupt interval so that it will contain the identical current frame display data that is stored in the pseudo-screen buffer.

Figures 3A, 3B, 3C, 3D, 3E:
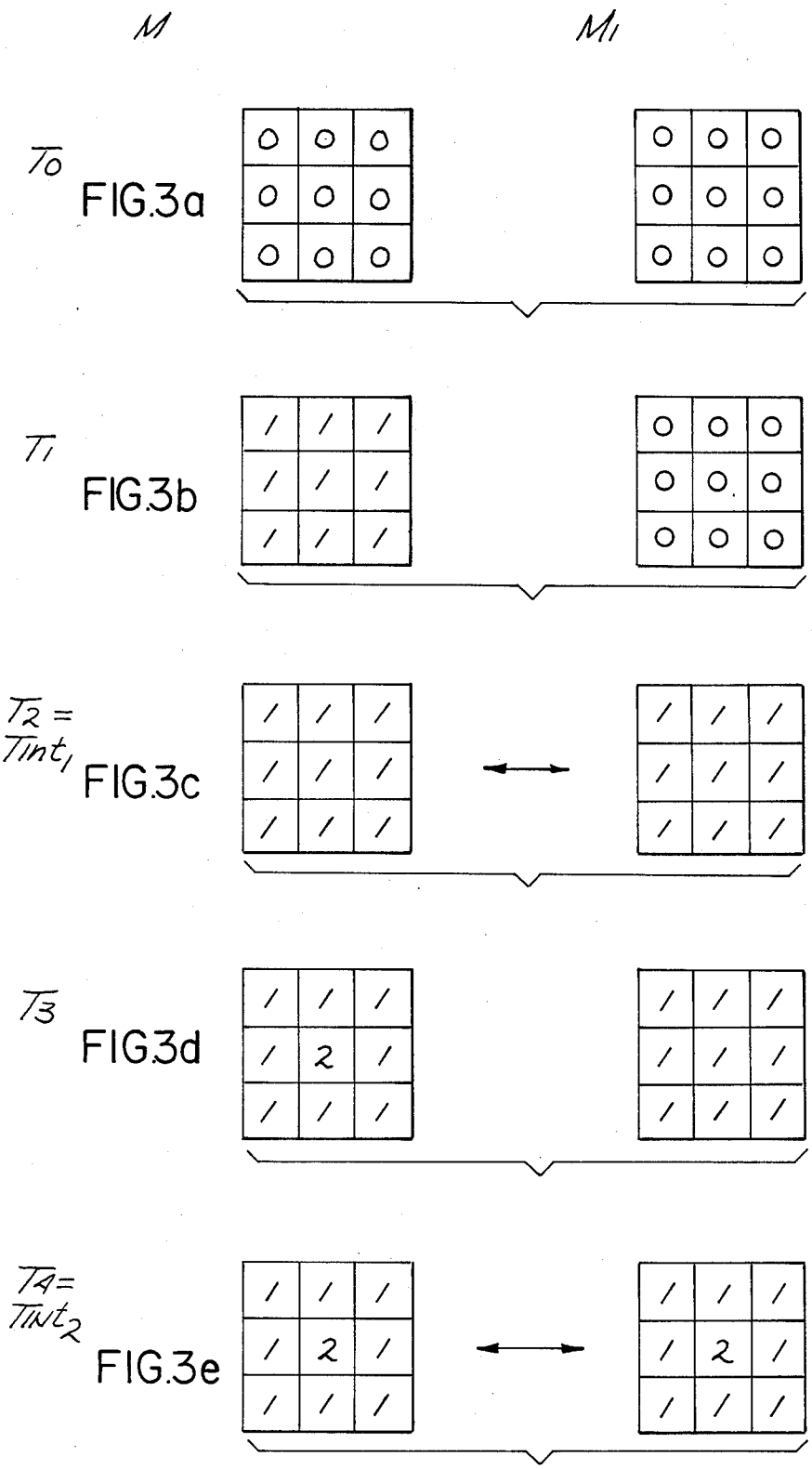
FIGS. 3(*a*) through (*e*) illustrate the use of a pseudo-screen buffer which stores display data written from an associated application program, and of a previous image buffer as a reference means, for storing current display data for updating changes in output display data that will appear on the video display.

Referring now to FIG. 3, the contents of the previous image buffer and an associated current pseudo-screen buffer at various times $T_x$ is shown to illustrate the updating of display data in accordance with the present invention.

In the examples shown in FIG. 3, it is considered that the present inventive system has been activated and a single application program is running in a window on the video display. It should be appreciated that the present invention is suitable for use with multiple applications running in multiple windows as well.

When display data is first written into a pseudo-screen buffer 18, the associated memory region of the previous image buffer 20 is typically blank. It will be appreciated, however, that it alternatively may contain residual display data, such as the contents of the last current full frame display data from a previous application program.

Thus, at time $T_0$, the pseudo-screen buffer and the associated previous image buffer memory region are blank, represented in FIG. 3(*a*) by zeros in all memory map locations M(x,y) and M'(x,y).

At some later time $T_1$, shown in FIG. 3(*b*), display data from the currently running application program are written into the associated pseudo-screen buffer shown here as a memory grid in which all memory locations store "1s". At time $T_2$, shown in FIG. 3(*c*), timer interrupt 30 interrupts the program operation, and the contents of the pseudo-screen buffer and previous image buffer are compared using operations well known in the art. Upon comparison, it is seen that all corresponding memory locations in the pseudo-screen buffer differ from those of the previous image buffer; that is all addresses of pseudo-screen buffer contain "1s" while all addresses of the previous image buffer contain "0s" or blanks.

During normal system operation between timer interrupts display data from current application programs are written directly into the pseudo-screen buffer as if being written directly to the screen buffer or the video display itself as in prior art systems. Without the previous image buffer as a reference means for detecting changes in pseudo-screen buffers 18, it would be necessary for the system to operate as if the entire contents of the pseudo-screen buffer 18 were continuously changed at each new time $T_n$. In that event, all memory locations of the pseudo-screen buffer would be continuously updated, even in those memory locations where no display data change had occurred, resulting in substantial increase in overhead and degradation in system performance. This drawback is overcome in the present invention by utilizing timer interrupt 30 in conjunction with the previous image buffer 20 for updating, such that only those locations in memory that have actually changed from time $T_n$ to time $T_{n+1}$ will be updated. It should be noted that other aspects of the present invention, including screen mapping and display data coordinate transformation also occur during selected interrupt intervals to further reduce system overhead.

Referring to FIG. 3(*c*), at time $T_2$, the previous image buffer is updated with the current frame display data written from corresponding coordinate memory locations in the pseudo-screen buffer during timer interrupt interval $T_{interrupt\ 1}$.

Referring to FIG. 3(*d*) at time $T_3$, it is shown in this example that the contents of memory location M (2, 2) has changed since time $T_2$ from display element "1" to "2". Thus, at time $T_4$ during timer interrupt interval $T_{interrupt\,2D}$ the current contents of M' (2, 2) of the previous image buffer is compared to corresponding contents of the pseudo-screen buffer and updated by writing a "2" from the pseudo-screen buffer into that address M' (2, 2).

During display data update, as well as during other operations performed utilizing the present inventive method and apparatus, the windowing environment is invisible to the writing of display data by application programs; that is, application programs do not call the windowing environment to determine the size, location, and video display area ownership for a window associated with display data of a particular application. Because the writing of windows to the video display in the windowing environment and the writing of application program display data to the pseudo-screen buffer are substantially independent operations, the application writes directly to the pseudo-screen buffer as if it were writing directly to the full video display without regard for the position or priority of current windows. Thus, the environment is not continuously informed as to when the application has written updated display data.

Comparing the buffers frequently will improve responsiveness by minimizing the time it takes for a character to be displayed. In particular, the more frequently a comparison is made, the more quickly a character written to the pseudo-screen buffer will be displayed to the screen. Comparisons made more frequently improve responsiveness to output operations whereas comparisons made less frequently enhance overall system performance by keeping overhead at a minimum. Thus, in the present invention, the frequency at which comparisons between the pseudo-screen buffer and the previous image buffer will be made, and the region of each buffer to be compared, is accomplished in accordance with a predetermined hierarchy of event priorities.

In one implementation of the present invention, the timer interrupt interrupts the current application program every 1/18 second. In accordance with preselected priorities, all memory locations of the pseudo-screen buffer and previous image buffer are compared and updated every eight timer interrupts. Comparison and update of the entire pseudo-screen buffer contents is performed with this frequency, inasmuch as it has been found that during typical user interaction with an application program running in windows this checking frequency substantially reduces processor overhead while maintaining high system performance. It has been empirically determined that, for example, when the comparison and update are performed during every timer interrupt, processor overhead exceeds 32%, but is reduced to approximately 4% when the frequency of comparison is reduced to once per eight timer interrupts.

When a change in application display data is detected and updated, a comparison and update is again performed at the next timer interrupt, but only in those portions of memory in the vicinity of the change. Thus, the frequency of comparing and updating accelerates as the frequency of change in display data output accelerates.

Comparison and update frequency also accelerates to occur at each timer interrupt immediately following the input of a character from a keyboard or other input device, since it has been found that further display data change is statistically expected immediately following character input.

Further, in the present embodiment, corresponding memory locations in the psuedo screen buffer and previous image buffer are compared every two timer interrupts along the row in the memory map corresponding to the row on which the cursor appears, because display data changes frequently in the vicinity of the line preceeding and following the cursor.

Of course, alternative event hierarchies may be used, and their priorities changed, to further optimize or vary the balance between system overhead reduction and increased interactive display response speed using the present inventive system.

Display Data Coordinate Transformation And Display Region Ownership

In the present invention, the operating environment, and thus the windows, are independent and logically isolated from the writing of the application program display data to the pseudo-screen buffer. The application program, as already described, writes a "full screen" of output data to its associated pseudo-screen buffer. It is, therefore, necessary to determine whether a given character stored in the pseudo-screen buffer does, in fact, appear in the visible portion of its associated window on the video display monitor. Also, given that a change in a character is discovered in the pseudo-screen buffer, an efficient method and apparatus is required to determine where to display that character on the video display. Using the present inventive system, this determination is independently made, as distinguished from prior art systems where the application program calls the operating environment to determine where display data will appear in a given window, and whether or not that data will be visible on the video display.

When operating in a windowing environment, one or more windows of selected dimensions may be "open", e.g. displayed on the video display monitor. In the present embodiment, the inventive system typically operates with windows that are rectangularly defined regions, but may also be applied to windows having other geometric configurations.

First, it is determined where each character stored in a pseudo-screen buffer would appear in the video display if it were in a window. Second, it is determined if that coordinate location is a currently visible coordinate stored on the video display. The location of characters on the video display is determined by performing a display data coordinate transformation. The present invention uses several operators which define character coordinate locations in the pseudo-screen buffer and on the video display for determining whether a character in the pseudo-screen buffer may be visible in an associated window on the video display.

Figure 4:
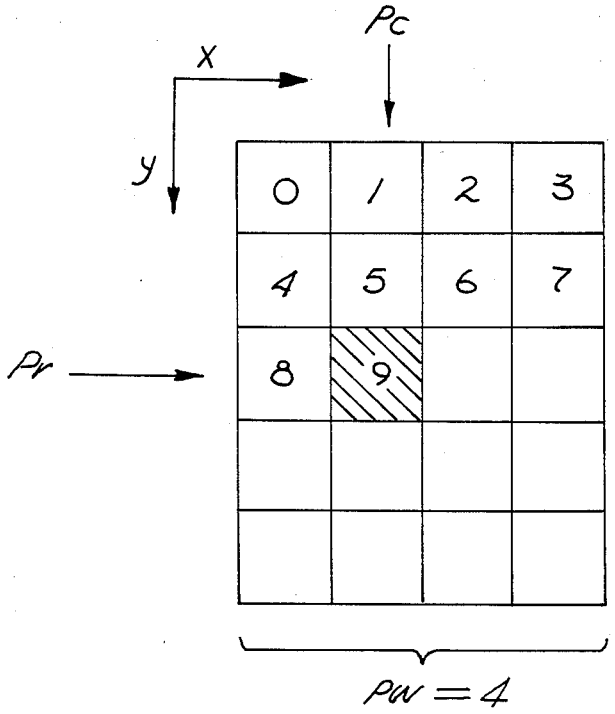
FIG. 4 symbolically illustrates the process of determining a memory grid offset, in particular connection with the pseudo-screen buffer offset.

The relation or positioning of the corner of the pseudo-screen buffer with respect to the corner or an associated window is first determined. With reference now to FIG. 4, the present invention's use of offset operators for determining associated display data coordinate locations in the pseudo-screen buffer corresponding to regions on the video display is shown. $P_r$ represents the number of the row of memory on the pseudo-screen buffer memory grid where the first character of display output data from the application program that will be visible in an associated window (if that window is visible on the display, i.e., has 'priority of ownership') is stored. Similarly, $P_c$ identifies the column number where the first character of output data is stored in the pseudo-screen buffer memory grid. $P_w$ represents the character width of the full pseudo-screen buffer.

From these operators, which identify coordinate locations on the pseudo-screen buffer memory grid, a pseudo-screen buffer offset $P_0$, is determined from the equation $P_{0'}=P_r\ P_w+P_{c'}$. $P_{0'}$ is best understood, by convention, as representing the memory region that precedes the first character stored in the pseudo-screen buffer when its memory grid is scanned across each row from right to left beginning with the uppermost row. For example, in a 4×4 memory grid such as shown in FIG. 4, it is seen that the first character of display output data resident M(2, 3). Thus, $P_{0'}=(2)(4)+(1)=9$ (counting columns and rows, beginning with zero, for purposes of the operators described to the relevant memory or character location.)

Similarly, screen offset $S_{0'}$ represents the memory region preceeding the first character of an associated window on a video display, such that $S_{0'}=S_rS_w+S_c$ where $S_r$ is the row of memory where the top row of the associated window appears; $S_w$ is the screen width of the video display, and $S_c$ is the column number of the video display for the first character of data in the associated window.

Thus, window offset is defined as the difference between the pseudo-screen buffer offset $P_{0'}$ and the screen offset $S_{0'}$; $W_0=P_{0'}-S_{0'}$. Knowing this window offset, the offset distance $S_o$ to any coordinate location on the video display can be determined for any character in an associated pseudo-screen buffer in accordance with the equation $S_0=P_0-W_0$ where $P_0$ is the pseudo-screen buffer offset of any arbitrary character in the pseudo-screen buffer to be displayed.

Figure 5A:
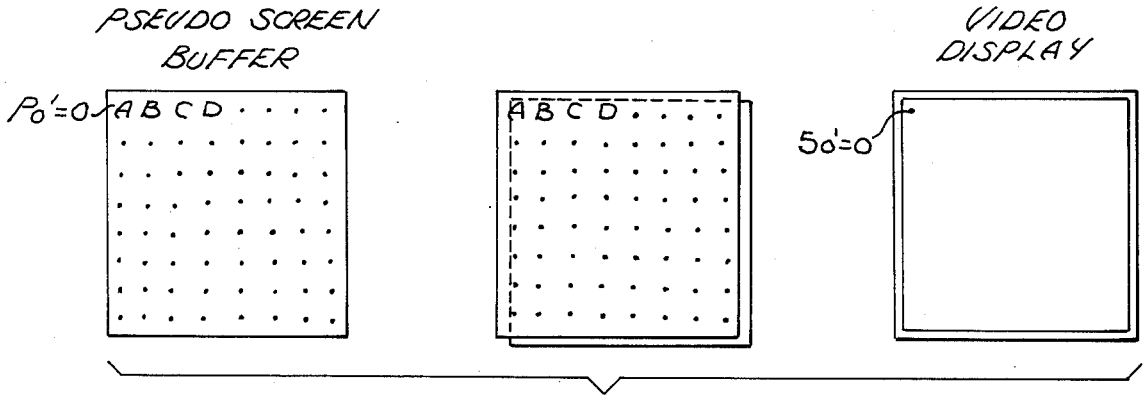
FIGS. 5(*a*) through (*d*) symbolically illustrate the process of determining the coordinate location of a character of display data within an associated window on the video display with respect to display data stored in a pseudo-screen buffer.
Figure 5B:
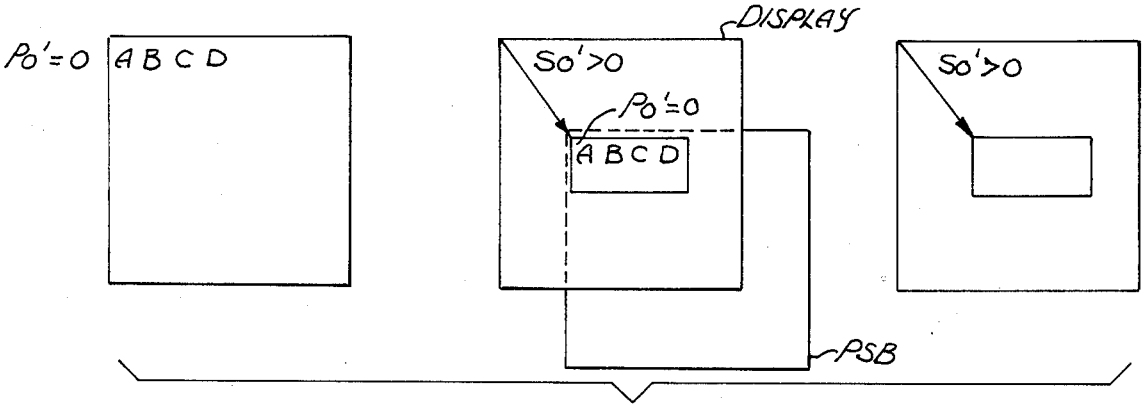

Similarly, FIG. 5(*c*) is a graphic representation of where $S_{0'}$ equals 0 (that is, its corner is coincident with the upper left hand corner of the video display) and $P_{0'}$ is not equal to 0. From $P_{0'}$ and $S_{0'}$, window offset $W_0$ is then determined, and used to determine where pseudo-screen buffer characters should appear in an associated window if they are visible.

Also, in typical prior art video display systems and memory architectures, a single application program is implemented at one time. Thus, the application program can write directly to the video display buffer without interfering with concurrent display data output, because only display data of that single application program will is typically displayed.

Referring to FIGS. 5(*a*) through 5(*d*), several examples of the implementation of display data coordinate transformation in conjunction with the present inventive system are provided. Turning to FIG. 5(*a*), when a full screen window is opened on the video display, such that the window and display borders are coincident, window offset, $S'_0=0$ and pseudo-screen buffer offset $P'_0=0$. That is to say, the first character that would be visible from the pseudo-screen buffer in an associated window is that character in the uppermost left hand corner coordinate of the pseudo-screen buffer. Further, the first character coordinate location in the window (storing an "A" in here) is coincident with the first available video display location, i.e., the uppermost left-hand corner coordinate of the video display. Thus, the window offset $W_0$, which is defined as $P'_0-S'_{0'}$ is zero. Thus, all display data in the pseudo-screen buffer is visible in identical coordinate locations on the display, since the window is a full size window and there are no overlapping windows obscuring that data.

If, in example 5(*b*), the first character of the pseudo-screen buffer would be visible in the window on the video display, then the pseudo-screen buffer offset $P_0=0$, (that is, the first character of information that would be visible on the video display is the first character appearing in the uppermost left hand corner of the pseudo-screen buffer).

Windows will typically be opened on some region of the video display such that the upper left-hand corner of the window is not coincident with the uppermost left-hand corner of the video display; for example, the centrally disposed window shown in FIG. 5(*b*). The screen offset $S_{0'}$ would not be 0, but rather would be some value represented by the equation $S_o=S_rS_w+S_c$.

Similarly, FIG. 5(*c*) is a graphic representation of where $S_{0'}$, equals 0 (that is, its corner is coincident with the upper left hand corner of the video display) and $P_{0'}$ is not equal to 0. From $P_{0'}$ amd $S_{0'}$, window offset is then determined and used to determine where psudo-screen buffer characters should appear in an associated window if they are visible.

Also, in typical prior art video display systems and memory architectures, a single application program is implemented at one time. Thus, the application program can write directly to the video display buffer without interfering with concurrent display data output, because only display data of that single application program will is typically displayed.

Typically, the pseudo-screen offset and the screen offset will both be greater than zero, as shown in FIG. 5(*d*). If display data is scrolled within a window as in FIG. 5(*a*), or otherwise manipulated or relocated, it is apparent that the first character visible within the window will not be the uppermost left hand character the application has written to the pseudo-screen buffer. Rather, the data which would be visible in the window (and in particular the first character thereof), will be written from some coordinate location M(x,y) other than M(0,0) of the pseudo-screen buffer.

Having determined the pseudo-screen buffer offset $P_{0'}$ and the screen offset $S_{0'}$, a window offset $W_0$ may be calculated. This parameter is again used to determine where a character written to the pseudo-screen buffer would appear within the associated visible window on video display.

"New" Screen offset, $S_0$, resulting from the change of a character or characters from the immediately previous image buffer can be determined by knowing the window offset already determined and a "new" pseudo-screen buffer offset $P_0$ which is the pseudo-screen buffer offset of some arbitrary character that has been changed during the update mode of a timer interrupt. This $P_0$ is determined in the same manner as $P_{0'}$, the only difference being that it now represents the offset of some arbitrary changed character rather than the first character of the pseudo-screen buffer that would be visible on video display. It should be noted that a $P_0$ will be calculated for each character change in the pseudo-screen buffer except those that are continguous along a row (or continguous endpoints between two rows).

If for example, text is scrolled upwardly within a window, as shown in 5(*e*) $P_o$ will change for A, B, C, and D.

The specific commands to be executed by the computer in order to implement the above coordinate transformation will be apparent to one skilled in the art, and will not be further described.

Thus, in the above manner, coordinate locations on a video display are determined for associated pseudo-screen buffer display data locations, or the converse, in connection with windows defined independantly by a windowing environment.

The Screen Map

When operating in a windowing environment, it is frequently desirable that multiple windows, or portions of windows, overlap on the video display with some pre-determined precedence. Of course, it is also desired that only pseudo-screen buffer display data that would appear in the visible portion of an associated window will be written to the video display. Accordingly, the present invention uses a screen map memory region 24 which is coupled to pseudo-screen buffers 18 and to the video display 26 to determine whether a video display region is visible for purposes of writing display data from an associated pseudo-screen buffer. The screen map is a memory mapped region which may be represented as an x by y memory grid having a parallel coordinate location for each character coordinate location on the video display.

Figure 6A:
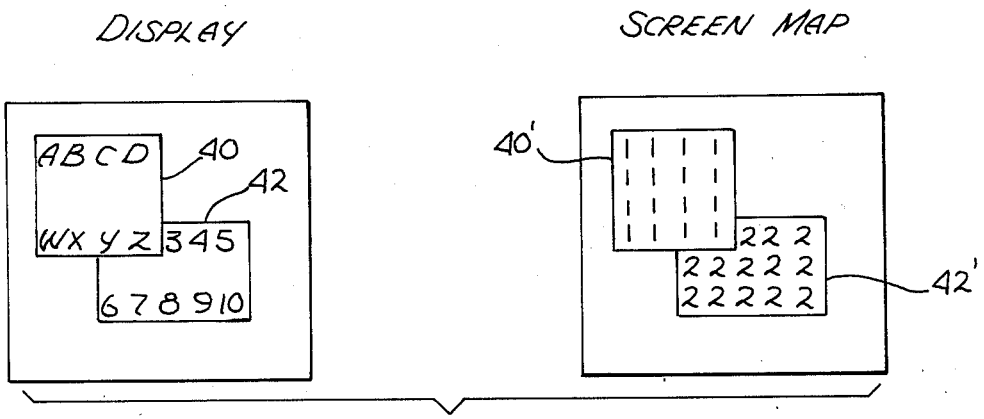
FIGS. 6(*a*) and 6(*b*) symbolically illustrate the operation of determining region ownership and priority of windows on the video display for display data to be written thereto from associated pseudo-screen buffer character locations.
Figure 6B:
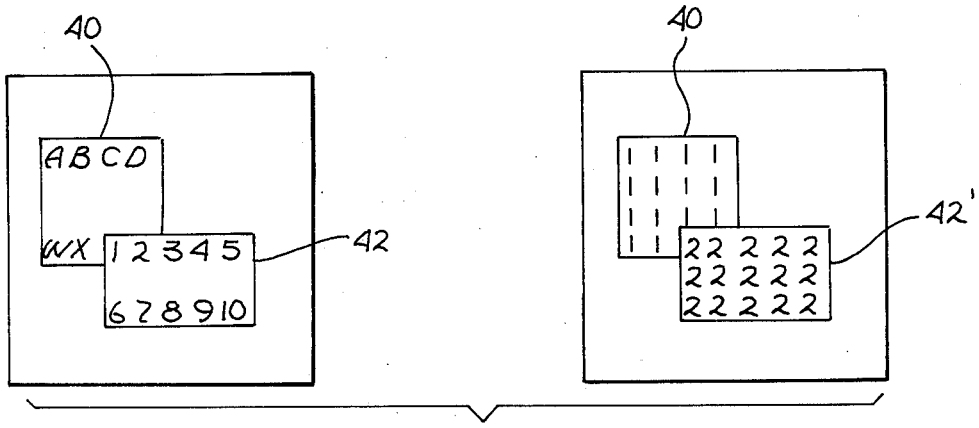

As shown in FIG. 6, a representation of each window region, e.g. 40 and 42, open on the video display is stored in the screen map, e.g. 40' and 42'. Each window 40' and 42' in the screen map is assigned an integer value 1 to n which corresponds to the integer value assigned to and identifying an associated pseudo-screen buffer. As previously described, the display data of a given pseudo-screen buffer that would be visible on the video display, if its associated window has priority of ownership, is determined by the display coordinate transformation.

Before display data will be displayed on the screen, however, each coordinate character location of a window represented in the screen map will have the assigned number of its associated pseudo-screen buffer written therein. Thus, as shown in FIGS. 6(*a*) and 6(*b*) each memory location in a screen map window representation will contain the identifying number of its associated pseudo-screen buffer. This number is written to all memory locations where display data will be visible in corresponding character locations on the video display. Thus, for every window region on the video display there is a number resident in the screen map which specifies which application programs display data owns a particular video display region.

Utilizing the window offset $W_0$, the coordinate locations of display data that will appear in a given window on a video display is determined. The corresponding location in the screen map is then read to determine if those locations on the video display are owned by an associated application program (i.e. not by another application or superseding region). If so, the video display data is written to the display from its associated pseudo-screen buffer.

As shown in FIG. 6(*a*), for example, two overlapping windows are currently visible on the video display. As further shown in FIG. 6(*a*), every character location of pseudo-screen buffer number 1 visible on the video display is identified by integer value 1 on the screen map, and thereby represents the corresponding area of ownership on the video display for pseudo-screen buffer 1. Thus, it is seen that while certain selected display data of pseudo-screen buffer 2 would appear in the uppermost left region of window 2 if it were visible, reading the screen map it is seen that this overlapping region is owned by window 1. Thus, this display data of pseudo-screen buffer 2 is not written to the video display.

Referring now to FIG. 6(*b*), if a user selects window 2 as his priority or "current" window, then the integer value 2 will be read from the area of intersection in the screen map, and the previously non-visible display data of pseudo-screen buffer 1 will be displayed at the previously non-visible intersection area on the screen.

CODING DETAILS

No particular programming language has been indicated for carrying out the various procedures described above. This is, in part, due to the fact that not all languages that might be mentioned are universally available. In practice, it has proven useful to substantially implement the present invention in an Assembly language or microcode which provides a machine executable object code.

Although the computers and the monitor systems which may be used in practicing the instant invention consist of may diverse elements and hardware components, a program listing, table 1 attached, has been provided for implementation on the computer known as the IBM XT, to provide a complete disclosure herein. Nevertheless it is considered that the operations and other procedures described above and illustrated in the accompanying drawings without reference to the attached listing are sufficiently disclosed to permit one of ordinary skill to practice the instant invention or so much of it as is of use to him.

Thus, methods and apparatus which are most advantageously used in conjunction with a digital computer to provide a video display system and memory architecture which enables use and manipulation of windows in an operating environment independantly of the writing of display data to a video display. In addition, using a timer interrupt, the apparatus and methods are implemented with high interactive display speed and significantly reduced processor overhead.

While the present invention has been particularly described with reference to FIGS. 1–6 and with emphasis on certain computer systems, it should be understood that the figures are for illustration only and should not be taken as limitations upon the invention. In addition, it is clear that the methods and apparatus of the present inventions have utility in any display device desired. It is contemplated that many changes and modifications may be made by one of ordinary skill in the art without departing from the spirit and scope of the invention as disclosed above.

I claim:

1. In a computer display system having a central processing unit (CPU), a memory architecture, display means for displaying output display data within a plurality of windows capable of overlapping on said display means, a plurality of applications programs each associated with one of said plurality of windows and having a display data stream including address information for enabling output display of a display screen of said display means, and first logic means for providing an operating environment for said computer system, the improvement comprising:

second logic means for providing a windowing environment for determining size and location of said windows and coordinate locations of data for display in said windows on said display, said second logic means independent of said first logic means;

a plurality of pseudo-screen buffer memory means, each of said pseudo-screen buffer memory means for storing display data from one of said applications programs for display in one of said plurality of windows, said pseudo-screen buffer memory means coupled to said CPU and to said second logic means;

said second logic means including identifying means for identifying one of said windows as a visible window, for identifying and updating sequentially occurring changes in said display data stored in said pseudo-screen buffer memory means, and for identifying portions of display output data stored in said pseudo-screen buffer memory associated with said visible window as visible data;

said identifying means including a timer interrupt means, a previous image buffer memory means for storing display data on one pseudo-screen buffer memory means associated with said visible window, comparing means for logically comparing the contents of said one pseudo-screen buffer associated with said visible window with said previous image buffer and determining differences between data stored in memory locations of said one pseudo-screen buffer and said previous image buffer, and writing means for writing data from said memory locations of said pseudo-screen buffer from which said differences have been identified into said previous image buffer to update said previous image buffer during selected timer interrupt intervals with the contents of said pseudo-screen buffer;

transfer means coupled to said pseudo-screen buffer memory means and to said display means for transferring visible data from said pseudo-screen buffer memory means associated with said visible window to said visible window.

2. The computer display system and memory architecture as claimed in claim 1 wherein said display data coordinate transformation means includes;

means for determining a first offset between a first coordinate display location of an associated window and a first coordinate display location of said video display;

means for determining a second offset between a first coordinate memory location of said pseudo-screen buffer and a first memory location within said pseudo-screen buffer associated with said windows;

logic means for determining the differences between said first offset and said second offset, said difference being defined as a window offset-utilized for determining the video display coordinate location of display data stored in said pseudo-screen buffer within an associated visible window on said video display.

3. The computer display system and memory architecture as claimed in claim 2 further including:

means for determining a third offset between memory locations of selectively changed characters within said pseudo-screen buffer changed between sequential timer interrupt intervals, and said first memory location of said pseudo-screen buffer.

4. The display system and memory architecture as claimed in claim 3 further including means for determining the location of said arbitrary or selectively changed characters on the visible portion of a window associated with said characters on the video display, whereby the location within the visible portion of a current window for display data associated with that window is determined.

5. The display system and memory architecture as claimed in claim 4 further including providing means for labelling each said pseudo-screen buffer.

6. The display system and memory architecture as claimed in claim 5, wherein the label of each pseudo-screen buffer corresponding to each said window is stored in memory locations of a screen map memory means which correspond to visible window locations of said video display.

7. A method for displaying information within windows which are capable of overlapping on a video display of a computer controlled video display system having means for controlling and defining said windows logically independent of an operating environment for writing of said video display data comprising the steps of:

storing said video display data at least one pseudo screen buffer memory means;

writing display data to said at least one pseudo screen buffer memory means without calling said operating environment;

storing in a previous image buffer current display area of said windows on said video display for video display data associated with said windows;

updating said display data written to said video display at selected timer interrupt intervals;

displaying said video display data associated with said windows from said pseudo screen buffer memory means on said visible display area of said windows.

8. The method as defined by claim 7, wherein the step of updating comprises the steps of:

comparing selective locations of said previous image buffer with corresponding memory locations of said at least one pseudo screen buffer;

selecting regions of memory of said at least one pseudo screen buffer to be compared, and selecting a frequency rate of comparison for said selected memory regions;

identifying differences between corresponding memory locations in said at least one pseudo screen buffer and said previous image buffer;

and writing the contents of corresponding memory locations of said pseudo screen buffer into said previous image buffer for memory locations where differences there between are identified.

9. The method as defined by claim 8, wherein said frequency of comparing and updating is increased when the frequency of display data change increases.

10. The method as defined by claim 9, further including the steps of:

labeling each pseudo-screen buffer with a label storing display data of a computer program associated with said pseudo-screen buffer for identifying each said pseudo-screen buffer;

storing said label for each memory location associated therewith in corresponding coordinate character locations within said representation of said windows in said screen map such that only a priority overlapping window stores its corresponding image buffer label at overlapping areas of said window within said screen map.

11. The method as claimed in claim 9 comprising the further step of writing display data from said previous image buffer into corresponding windows on said video display for each corresponding memory location of said previous image buffer having its corresponding label stored in said screen map representation of said windows, whereby display data is displayed only in visible portions of windows defined on said video display.

12. The method as defined by claim 7 further including the steps of:

defining an offset operator for display data coordinates of display data stored within said pseudo screen buffer memory means corresponding to the location of said display data in said pseudo screen buffer memory means for a window associated therewith in said video display, said offset operator to determine coordinate locations at which said display data will be written to said video display when said display data is visible on said video display;

determining the locations at which said display data will be written in said visible portions of said video display;

providing a screen map memory region for mapping an image representation of said windows defined on said video display;

identifying coordinate character locations within said windows in said screen map corresponding to visible coordinate character locations of said display data on the video display.

13. The method as defined by claim 12 wherein the steps of transforming display data coordinates and applying said offset operator comprises the steps of:

determining a first screen offset representing the relational position of the first coordinate display location of a corresponding window from the first coordinate display location of said video display;

determining a first pseudo-screen buffer offset representing the relational position of the first coordinate memory location within said pseudo-screen buffer associated with said a corresponding window from the first coordinate memory location of said pseudo-screen buffer; and determining the difference between said first screen offset and said pseudo-screen buffer offset to define a constant for determining the video display coordinate location of display data stored in said pseudo-screen buffer within corresponding visible window on said video display.

* * * * *